US007059958B2

(12) United States Patent
Santos

(10) Patent No.: US 7,059,958 B2
(45) Date of Patent: Jun. 13, 2006

(54) ELEVATOR CABIN WITH INTEGRATED VENTILATION SYSTEM

(75) Inventor: Agnaldo Santos, Sao Paulo (BR)

(73) Assignee: Inventio AG (CH)

( * ) Notice: Subject to any disclaimer, the term of this patent is extended or adjusted under 35 U.S.C. 154(b) by 0 days.

(21) Appl. No.: 11/005,147

(22) Filed: Dec. 6, 2004

(65) Prior Publication Data

US 2005/0124282 A1 Jun. 9, 2005

(30) Foreign Application Priority Data

Dec. 8, 2003 (EP) ..... 03405877

(51) Int. Cl.
*F24F 7/00* (2006.01)

(52) U.S. Cl. ..... 454/68; 454/256; 454/262

(58) Field of Classification Search ..... 454/68, 454/343; 187/393, 414
See application file for complete search history.

(56) References Cited

U.S. PATENT DOCUMENTS 1,033,963 A * 7/1912 Surprise ..... 181/224
1,767,988 A * 6/1930 Knapp ..... 454/68
2,310,414 A 2/1943 Fritzam et al.
5,354,233 A * 10/1994 Mandy et al. ..... 454/68
5,593,347 A * 1/1997 Mandy et al. ..... 454/68

FOREIGN PATENT DOCUMENTS

EP 0 545 131 A1 6/1993
JP 08-188360 7/1996
JP 2001 294 384 10/2001

* cited by examiner

*Primary Examiner*—Derek S. Boles
(74) *Attorney, Agent, or Firm*—Klaus P. Stoffel

(57) ABSTRACT

An elevator cabin with an integrated ventilation system. A fan is attached to the elevator cabin and a vertical side wall of the elevator cabin has a plurality of distributed ventilation holes. At least one air channel element is attached to the side wall, so that the air channel element together with the adjacent portion of the side wall forms an air channel. An adapter element is situated between the fan and an inlet opening of the air channel for guiding air from the fan into the air channel so that the air travels from the fan through the adapter element into the air channel and through the ventilation holes into the elevator cabin.

12 Claims, 2 Drawing Sheets

ELEVATOR CABIN WITH INTEGRATED VENTILATION SYSTEM

The present invention relates to an elevator cabin having an integrated ventilation system.

BACKGROUND OF THE INVENTION

Some elevator cabins simply have air inlet and outlet openings in the lower and upper portion of the elevator cabin body. These inlets and outlets are in direct connection with the outside air.

Many elevator cabins nowadays comprise a motor driven fan mounted on the roof of the cabin. The motor drives a fan blade to draw air from the elevator shaft into the elevator cabin and from there back into the elevator shaft. Conventional cabins have a simple fan opening in the ceiling which serves as an air inlet and sometimes simple ventilation openings in the side walls. The air inlet may be covered by an air duct.

It is a drawback of certain ventilation systems that noise from the operating apparatus of the elevator enters into the elevator cabin through the different ventilation openings.

JP-2001 294 384 discloses an elevator cabin which is fairly well protected against noise from the operating apparatus of the elevator. The elevator cabin has a wall plate rising from the cabin floor, with a ventilation hole in the lower edge area of the wall plate. A fan is installed on a ceiling plate of the elevator cabin. The elevator cabin comprises a vertical air channel extending along the wall plate, delimited by a wall plate portion and by an air channel element having a groove-like section. The air channel element is fixed to the area of the wall plate portion. The upper end of the air channel communicates directly with the elevator shaft. The lower end of the air channel communicates with the cabin through the ventilation hole. The fan pushes air into the elevator cabin. The air travels downwards through the elevator cabin, leaves the elevator cabin through the ventilation hole, travels upwards through the air channel and finally flows from the air channel into the elevator shaft.

Although this elevator cabin is fairly well protected against noise entering through ventilation openings in its side walls, it has certain drawbacks.

One drawback is that the elevator cabin is not protected against noise entering from the ceiling. A drop ceiling in the elevator cabin reduces this noise, apart from the fact that it provides for an esthetic appearance. But if a drop ceiling is employed in the cabin, it is not as easy to obtain a satisfactory ventilation of the elevator cabin, since the drop ceiling restricts the air flow.

Another drawback of this elevator cabin is that the venting is effected by air being fed to the elevator cabin through one inlet only. Hereby the ventilating air will travel with high velocity, so that passengers will be exposed to a draft. Also, the air will not be distributed evenly in the elevator cabin. Further, the direction of the ventilating air from the ceiling to the floor usually is not comfortable for the passengers.

SUMMARY OF THE INVENTION

Accordingly, it is an object of the present invention to provide an elevator cabin with a ventilation system without the drawbacks mentioned above. The new elevator cabin should be protected against noise from the operating apparatus of the elevator system and should comprise an efficient ventilation system, without increasing costs of the cabin.

In accordance with the invention, the elevator cabin has at least one integrated air channel extending essentially in a vertical direction along the side walls of the elevator cabin, and a fan attached to the elevator cabin. One end of each air channel is connected to the fan by an adapter element. The air channel is delimited by a lengthy portion of the side wall of the elevator cabin and by an air channel element affixed to the side wall in the area of the lengthy portion. Each air channel communicates directly with the elevator cabin via a plurality of ventilation holes. The air flows from the fan through the adapter elements into the air channels, then through the ventilation holes into the elevator cabin and from the elevator cabin back into the elevator shaft.

The ventilation system and the elevator cabin in accordance with the invention have a number of important benefits:

- The comfort of the passengers is improved, due to the new system of air distribution. Not only is noise greatly reduced, but the air is distributed uniformly in the entire elevator cabin. Any draft is prevented and air is not fed from the ceiling but instead from the side.
- Optionally, the ventilation holes can be arranged so that the air is not fed at 90° from the side walls, hereby a circulating effect can be created, either in horizontal direction or slightly inclined.
- The esthetic aspect of the interior of the elevator cabin is improved, due to the reduced dimensions of the ventilation holes. The distribution of the ventilation holes can even be used to achieve decorative effects. It is also possible to distribute the ventilation holes in the form of letters to provide information for the passengers.
- The costs of the ventilation system are low. Although the air is fed to the elevator cabin through a plurality of ventilation holes, the system works with a single fan.
- The side walls or panels of the elevator cabin are reinforced due to the integrated air channels. Due to this reinforcing effect, lighter side walls, respectively panels, can be used. This too reduces the costs not only of the constructive elements of the elevator but also the operating costs.
- The fan can be mounted at any suitable location outside the cabin, usually above the ceiling respectively on the roof or underneath the floor. Since it is not necessary to mount the fan on the roof, the space above the elevator cabin can be used for other components of the elevator or for maintenance.
- Due to the flexibility in construction, the new ventilation system can also be used for upgrading older elevator systems.

Other features and advantages of the present invention will become apparent from the following description of the invention which refers to the accompanying drawings.

BRIEF DESCRIPTION OF THE DRAWINGS

For a more complete description of the present invention and for further objects and advantages thereof, reference is made to the following description, taken in conjunction with the accompanying drawings, in which.

DETAILED DESCRIPTION OF THE INVENTION

Figure 1:
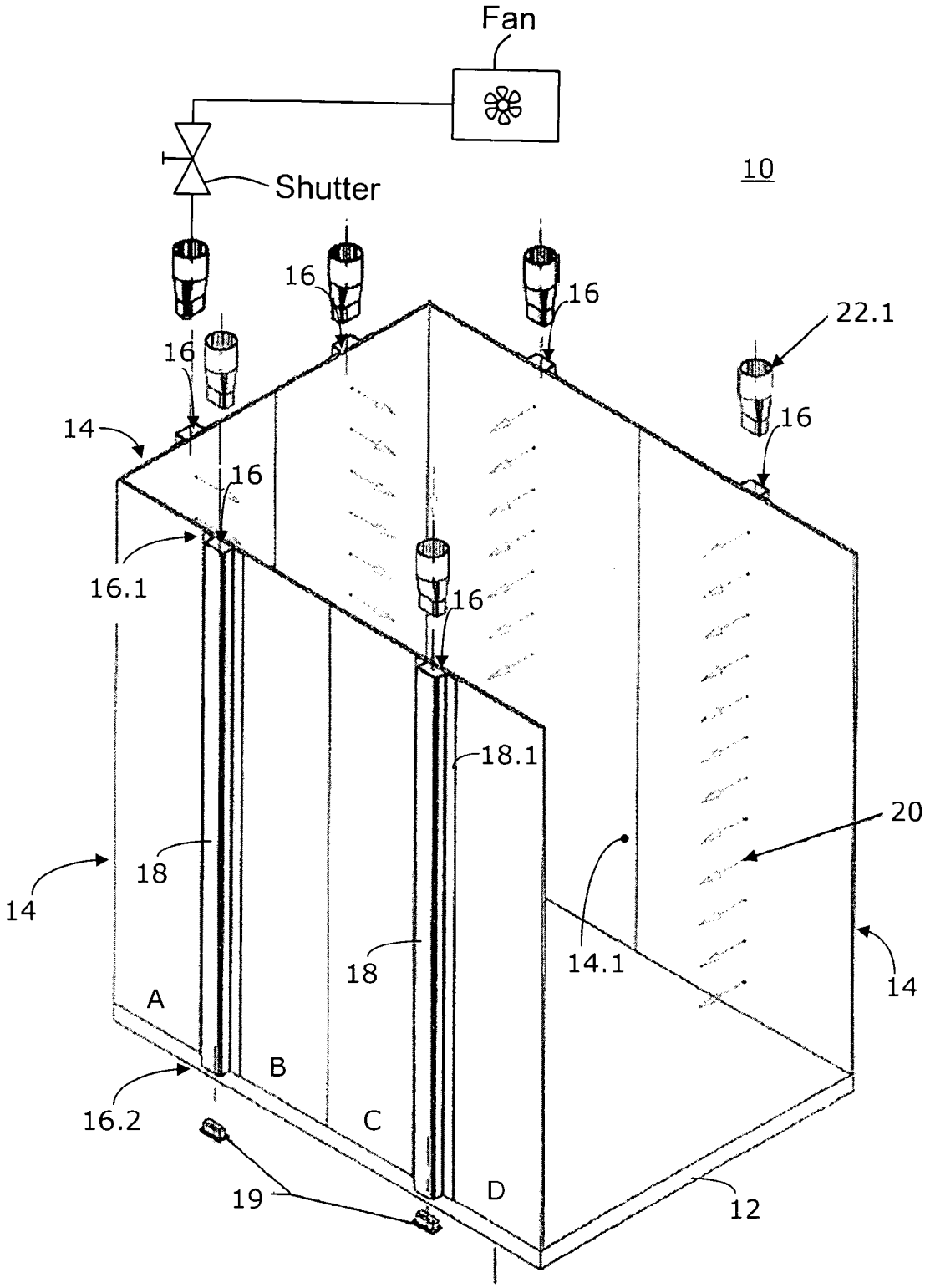
FIG. 1 is a schematic representation of an elevator cabin with an integrated ventilation system, according to a preferred embodiment of the present invention.

FIG. 1 shows the inner part of an elevator cabin 10 in accordance with the present invention. The inner part of elevator cabin 10 comprises a floor 12, a ceiling or roof 13, shown only in FIG. 2A, and side walls 14. The side walls 14 have inner surfaces 14.1 facing the inner room of the elevator cabin 10 and outer surfaces 14.2 facing the mechanical structure of the elevator cabin or the shaft in which the elevator cabin can move up- and down-wards. Neither the mechanical structure of the elevator cabin nor the elevator shaft are shown in FIG. 1.

Vertical air or ventilation channels 16 are disposed along the side walls 14 of the elevator cabin 10. In the embodiment represented in FIG. 1, each of the side walls 14 has two air channels 16.

In other embodiments, not shown, the air channels are not disposed entirely in vertical direction, and each side wall of the elevator cabin may have more or less than two air channels, or a part of the side walls of the elevator cabin may be without any air channel.

Figure 2A:
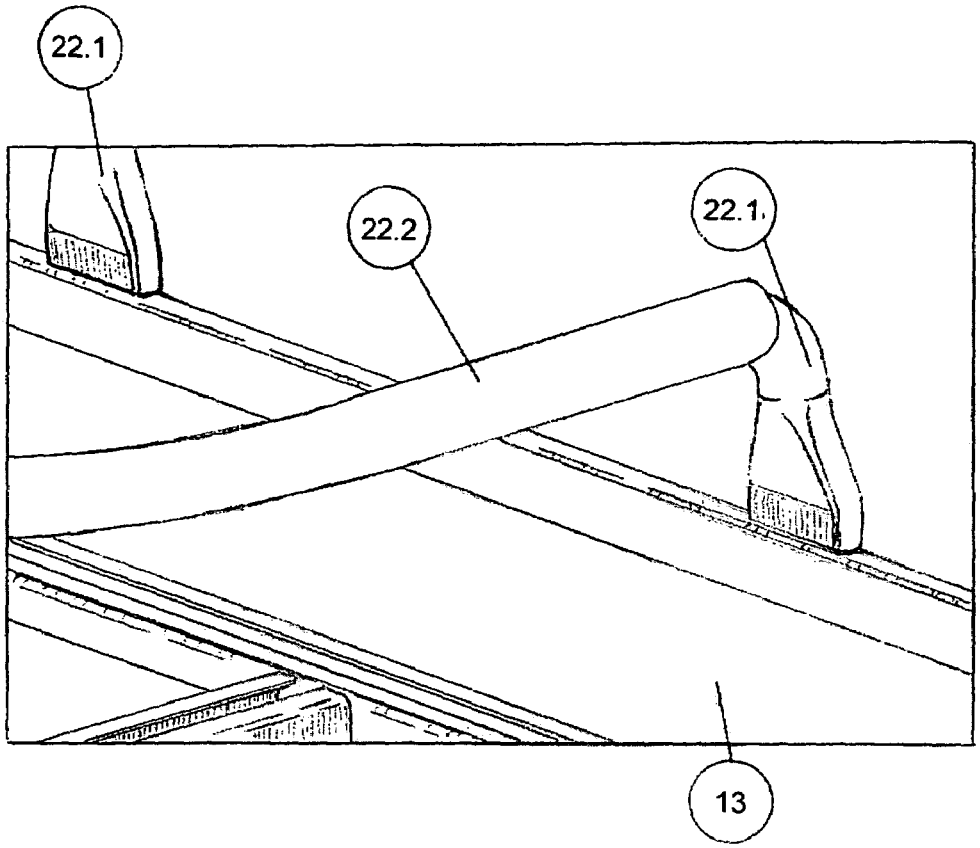
FIG. 2A is a schematic detailed representation of the cabin roof with an adapter element comprising an adapter insertion piece and a hose, seen from the top.
Figure 2B:
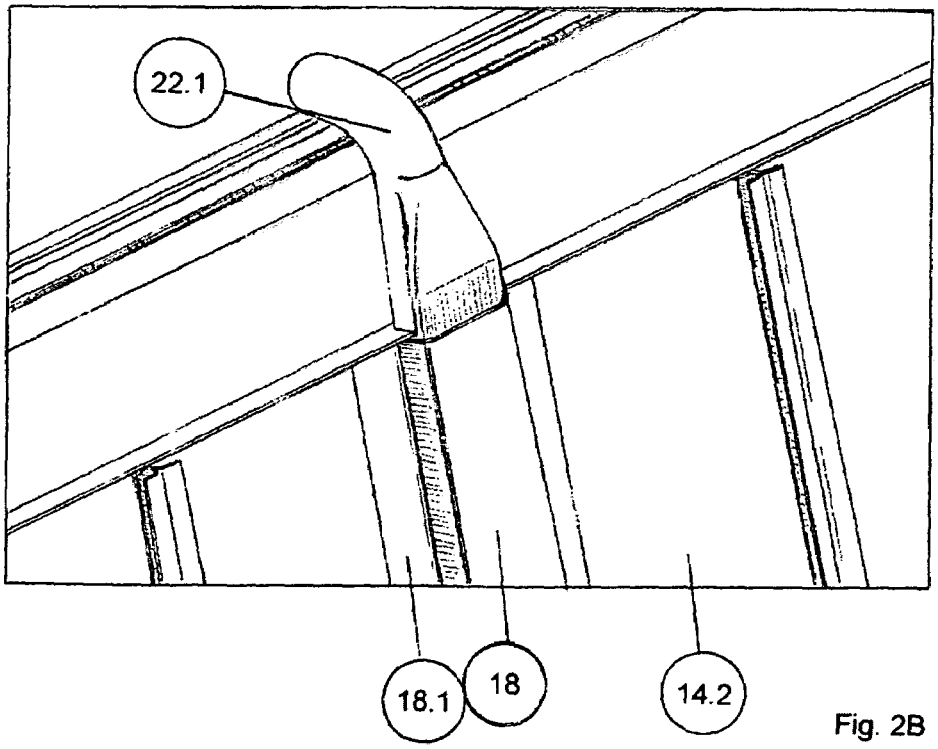
FIG. 2B is a schematic detailed representation of the air channels with inserted adapter insertion pieces, seen from the outside of the elevator cabin.

The air channels 16 have rectangular cross-sections, as shown in detail in FIG. 2B. For each air channel 16 an air channel element 18 in form of a U-shaped profile is fixed to the outer face 14.2 of the side wall 14 of the elevator cabin 10. The air channel element 18 has flanges 18.1 extending laterally from the ends of its free edges. Each air channel 16 thus has a rectangular cross-section, whereby three walls are constituted by the air channel element 18 and the fourth wall is constituted by a portion of the side wall 14 of the elevator cabin 10.

In other embodiments, not shown, air channel elements are fixed to the inner face of the side walls of the elevator cabin. The air channels can also have other cross-sections than rectangular ones, e.g., trapeze-like sections or half-round sections but in any case sections forming grooves. Further the air channels can be delimited by a groove formed in a panel of the side wall and an air channel element in form of a profile or plate covering said groove. It is convenient for making the ventilation system but it is not necessary for its function to provide air channels having a section of identical shape and size all along the elevator cabin.

The air channel element 18 delimiting the ventilation channel 16 is fixed to the side wall 14 of the elevator cabin by welding or gluing. It can also be fixed by mechanical means like rivets or screws, but in this case it may be necessary to use joints, at least when the air channel element 18 would be fixed to the inner surface 14.1 of the side wall 14 of the elevator cabin 10. In any case, air flowing through the air channels 16 should be prevented from escaping into the elevator shaft, because this would reduce the venting effect in the elevator cabin 10.

Independently on how the air channel 16 is delimited, the strength of the side wall(s) of the elevator is enhanced by the air channels projecting from the vertical plane of the side walls of the elevator cabin. This reinforcing effect is even better when the air channels are pressurized.

The air channels 16 have first ends 16.1 which are open and second ends 16.2 which are closed by means of closing elements or plugs 19.

Each air channel 16 is connected to the inner room of the elevator cabin 10 by a plurality of ventilation holes 20 distributed over the length of the wall which separates the air channel 16 from the inner room of the elevator cabin 10. In the embodiment depicted in FIG. 1, the ventilation holes 20 are disposed in the side wall 14 of the elevator cabin 10.

A fan, shown in FIG. 1, is attached to the elevator cabin 10. The fan preferably is a blowing fan but a suction fan can also be used.

The ventilating air is fed to the air channels 18 through an adapter element 22, shown in more detail in FIG. 2B. The adapter element 22 comprises in any case an adapter insertion piece 22.1 which is inserted in the open end 16.1 of the air channel 16.

Either the ventilating air is fed to the adapter insertion piece 22.1 through a tube or hose 22.2 connecting the adapter insertion piece 22.1 to the fan, as shown in FIG. 2A. Or the ventilating air is fed to the adapter insertion piece 22.1 from a chamber pressurized by the fan.

In the embodiment shown in FIGS. 1 and 2, the fan is attached above the ceiling respectively on the roof of the elevator cabin 10, and the lower ends 16.2 of the air channels are closed.

The fan may also be attached elsewhere to the elevator cabin. If the fan is attached underneath the floor of the elevator cabin 10, the air will be fed to the lower ends 16.2 of the air channels 16 and the upper ends 16.1 of the air channels 16 will be closed.

According to another embodiment, the elevator comprises at least one shutter that can be mechanically or electrically actuated. The shutter can be used to open or close an air channel. It is also possible to employ switches, preferably switches that can be mechanically or electrically actuated, that allow air to be redistributed according to current needs.

According to yet another embodiment, the elevator cabin's vertical side wall 14 comprises for example four thin panels A through D, as shown in FIG. 1, that are connected and mounted by the two vertical air channel elements 18. The two vertical air channel elements 18 provide for the mechanical stability of the vertical side wall.

The ventilation system may be designed such that in an emergency situation, e.g. in case of fire, the atmosphere in the cabin is controlled to provide air to the passengers that may be locked in the cabin, for instance.

It is an advantage of the present invention that air is fed into the cabin without creating any draft or noise.

In the drawings and specification there has been set forth preferred embodiments of the invention and, although specific terms are used, the description thus given uses terminology in a generic and descriptive sense only and not for purposes of limitation.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An elevator cabin with an integrated ventilation system, comprising:

a fan;

a vertical side wall with a plurality of ventilation holes distributed over the length of the side wall;

at least one air channel element attached to the side wall so that the air channel element together with the side wall forms an air channel; and an adapter element situation between the fan and an inlet opening of the air channel for guiding air from the fan into the air channel so that the air travels from the fan through the adapter element into the air channel and through the ventilation holes into an interior of the elevator cabin.

2. The elevator cabin according to claim 1, and further compromising a ceiling arranged above the vertical side wall, the fan being attached above the ceiling.

3. The elevator cabin according to claim 1, wherein the adapter element includes a hose and an insertion piece configured to connect the fan to the air channel.

4. The elevator cabin according to claim 1, wherein the adapter element includes a tube and an insertion piece configured to connect the fan to the air channel.

5. The elevator cabin according to claim 1, and further comprising a closing element arranged to close an open end of the air channel opposite the inlet opening.

6. The elevator cabin according to claim 1, wherein the vertical side wall comprises at least two panels connected together and mounted by the air channel element.

7. The elevator cabin according to claim 1, and further comprising at least one shutter operatively arranged to open and close the air channel.

8. The elevator cabin according to claim 7, wherein the shutter is mechanically or electrically operable.

9. The elevator cabin according to claim 1, and further comprising at least one switch operative to redistribute the air.

10. The elevator cabin according to claim 9, wherein the switch is mechanically or electrically operable.

11. The elevator cabin according to claim 7, and further compromising at least one switch operative to redistribute the air.

12. The elevator cabin according to claim 11, wherein the switch is mechanically or electrically operable.

* * * * *